US012085349B2

(12) United States Patent
Schrödl

(10) Patent No.: US 12,085,349 B2
(45) Date of Patent: Sep. 10, 2024

(54) MAGAZINE CATCH BODY

(71) Applicant: SAKO OY, Riihimäki (FI)

(72) Inventor: Christoph Schrödl, Porvoo (FI)

(73) Assignee: SAKO OY, Riihimäki (FI)

( * ) Notice: Subject to any disclaimer, the term of this patent is extended or adjusted under 35 U.S.C. 154(b) by 0 days.

(21) Appl. No.: 17/999,105

(22) PCT Filed: May 20, 2021

(86) PCT No.: PCT/EP2021/063480
§ 371 (c)(1),
(2) Date: Nov. 17, 2022

(87) PCT Pub. No.: WO2021/234095
PCT Pub. Date: Nov. 25, 2021

(65) Prior Publication Data

US 2023/0194198 A1 Jun. 22, 2023

(30) Foreign Application Priority Data

May 20, 2020 (FI) ..... 20205513

(51) Int. Cl.
*F41A 17/38* (2006.01)
*F41A 35/06* (2006.01)

(52) U.S. Cl.
CPC ..... *F41A 17/38* (2013.01); *F41A 35/06* (2013.01)

(58) Field of Classification Search
CPC ..... F41A 17/38; F41A 35/06
See application file for complete search history.

(56) References Cited

U.S. PATENT DOCUMENTS 4,429,479 A 2/1984 Johnson
5,519,954 A 5/1996 Garrett
7,921,587 B2 4/2011 Mayberry
(Continued)

OTHER PUBLICATIONS

International Search Report and Written Opinion in International Application No. PCT/EP2021/063480, mailed Sep. 10, 2021, 13 pages.

(Continued)

*Primary Examiner* — Reginald S Tillman, Jr.
(74) *Attorney, Agent, or Firm* — Meunier Carlin & Curfman LLC

(57) ABSTRACT

A magazine catch body comprising a magazine and a magazine catch body comprising magazine catch buttons extended left and right, a magazine catch shaft connecting the magazine catch buttons to each other, and a magazine catch lever connected to the shaft for transmitting locking-releasing movements of the magazine catch buttons to the magazine to lock and release the magazine to the firearm, is disclosed. The magazine catch body comprises a spring around the shaft. The magazine catch buttons are substantially symmetrically located in respect of the firearm. The magazine catch buttons form the magazine catch body to one structural unity functionable as one mechanism. The magazine catch button extended left comprises a necked part pressing the lower receiver and receiving draw of the spring causing a holding force. In the necked part is an opening for a pin forming a turning axis of the magazine catch button extended left.

12 Claims, 6 Drawing Sheets

(56) References Cited

U.S. PATENT DOCUMENTS

| | | | | |
|---|---|---|---|---|
| 8,713,832 | B2 * | 5/2014 | Troy | F41A 35/06 42/6 |
| 9,429,375 | B2 | 8/2016 | DeSomma et al. | |
| 10,234,226 | B1 | 3/2019 | Copeland | |
| 2015/0323271 | A1 | 11/2015 | Mcginty | |
| 2016/0069628 | A1 | 3/2016 | Fluhr et al. | |

OTHER PUBLICATIONS

Search Report in Finnish Application No. 20205513, dated Dec. 18, 2020, 1 page.

* cited by examiner

MAGAZINE CATCH BODY

CROSS REFERENCE TO RELATED APPLICATIONS

This application is a United States National Phase Patent Application of International Patent Application Number PCT/EP2021/063480 filed on May 20, 2021, which claims the benefit of priority to FI Application No. 20205513, filed May 20, 2020.

TECHNICAL FIELD

The present invention relates generally to firearms, in particular to magazine catch bodies for firearms, especially for automatic and semi-automatic firearms. More precisely the present invention relates to a magazine catch body of a firearm according to the preamble part of claim 1.

BACKGROUND

In firearms, usually in semi-automatic or automatic firearms, is a magazine for ammunition. The magazine is locked/released to/from the firearm by a magazine catch body.

In patent publication U.S. Pat. No. 7,921,587 B2 is disclosed an ambidextrous magazine release for a firearm, the firearm having a magazine well configured to operatively receive a magazine, the magazine having a side locking recess within the magazine well when operatively received therein, the ambidextrous magazine release comprising a linkage movable between an engaged position and a disengaged position having a lock pin configured to be received in a side-locking recess of a magazine operatively received in the magazine well with the linkage in the engaged position and to clear the side-locking recess with the linkage in the disengaged position, a one piece actuator on the firearm, the actuator comprising a bar having opposing push surfaces extending between a right and a left side of the firearm and an interface between the linkage and the actuator, the interface being configured so that as the either of the opposing push surfaces of the bar is pushed by a user, the linkage is moved between the engaged and the disengaged position, wherein the linkage interface comprises a recess in the bar defining a pair of converging cam surfaces and a cam rider extending from the linkage into contact with the cam surfaces, the linkage being in the engaged position with the cam rider at the convergence of the cam surfaces.

In patent publication U.S. Pat. No. 9,429,375 B2 is disclosed a rifle, comprising a lower receiver, a magazine catch spring at least partially installable within the lower receiver, a magazine release button operatively engaging a first end of the magazine catch spring, the magazine release button movably installed in the lower receiver, an ambidextrous magazine release button pivotally installed within the lower receiver and configured to pivot about a pivot screw in the lower receiver and a magazine catch moveably installed in the lower receiver, the magazine catch comprising a first portion that operatively engages the magazine release button and a second portion that operatively engages the ambidextrous magazine release button, wherein the first portion of the magazine catch is at least partially installed through the magazine catch spring.

In patent publication U.S. Pat. No. 5,519,954 A is disclosed an ambidextrous magazine release and retaining mechanism for use with a gun, comprising: a rod having first and second ends transversely and slidably mounted within the gun; a first spring for biasing the rod towards the first end thereof; a pushbutton connected to the first end of the rod for pushing the rod against the bias of the first spring; a base connected to the second end of the rod; a lever having first and second ends; the first end of the lever for engaging with the magazine and the second end of the lever including a pressing surface which when pressed towards the gun moves the first end of the lever away from the magazine, the pressing surface of the second end of the lever disposed exterior to the gun and directly pressable by a user; a pivot between the first and second ends of the lever mounting the lever to the base; and a second spring for biasing the lever so that the first end thereof is biased towards the magazine.

Sometimes the magazine catch bodies known from prior art have rattling and clanging, which is caused by plays in the assembly.

An object of the present invention is to create a magazine catch body of a firearm by which the above described problems and disadvantages of magazine catch bodies known from prior art are eliminated or at least minimized.

Another object of the present invention is to create an improved magazine catch body of a firearm, in which ergonomics for the user is improved.

Another object of the present invention is to create an improved magazine catch body of a firearm, in which rattling, and clanging is eliminated or at least minimized.

Another object of the present invention is to create an improved magazine catch body of a firearm, in which robust locking of the magazine to the firearm is achieved.

Another object of the present invention is to create an improved magazine catch body of a firearm, which is easy to use and well-reachable by the user during operation of the firearm.

Another object of the present invention is to create an improved magazine catch body of a firearm for fast and secure magazine changes.

SUMMARY

In order to achieve the above objects and those that will come apparent later the magazine catch body of a firearm is mainly characterized by the features of the characterizing part of claim 1.

Dependent claims present advantageous features and embodiments of the invention.

According to the invention the magazine catch body of a firearm, which firearm comprises a magazine and a magazine catch body, wherein the magazine catch body comprises a magazine catch button extended left, a magazine catch button extended right and a magazine catch shaft configured to connect the magazine catch button extended left and the magazine catch button extended right to each other, wherein the magazine catch body further comprises a magazine catch lever connected to the magazine catch shaft and configured to transmit locking and releasing movements of the magazine catch button extended left and the magazine catch button extended right to the magazine of firearm to lock and to release the magazine to the firearm, correspondingly, wherein the magazine catch body further comprises a spring located around the shaft, the magazine catch button extended right and the magazine catch button extended left are substantially symmetrically located in respect of the firearm and the magazine catch button extended left and the magazine catch button extended right are configured to form the magazine catch body to one structural unity and functionable as one mechanism, the magazine catch button extended left of the magazine catch body comprises a necked part and a widened part and in the necked part an opening is located for a pin configured to form a turning axis of the magazine catch button extended left and the necked part of the magazine catch button extended left is configured to press against the lower receiver of the firearm and to receive draw of the spring causing a holding force.

According to an advantageous feature of the invention an air gap is located between the magazine catch lever and the lower receiver of the firearm, whereby the magazine catch button extended left rests on the outer surface of lower receiver of the firearm and thus the rattle-free magazine release is further improved.

According to an advantageous feature of the invention the widened part of the magazine catch button extended left is asymmetrically widened towards the user of the firearm. Thus, the magazine catch button extended left is extended towards the trigger and the trigger-guard of the firearm According to an advantageous feature of the invention the widened part of the magazine catch button extended left is elevated in the area of the surface of the firearm.

According to an advantageous feature of the invention the magazine catch button extended left comprises a groove like joining area of the necked part and the widened part towards the outer surface of the firearm.

According to an advantageous feature of the invention the pin mounted in the opening of the necked part of the magazine catch button extended left is configured to form an attachment for the magazine catch button extended left and an axis for the turning movement of the magazine catch button extended left between the locking, standard position and the releasing position for the magazine of the firearm.

According to the invention the opening for the pin decreases towards the front of the firearm, which prevents the pin to move from its position due to forces caused by firing the firearm. Thus, the opening for the pin decreases towards the barrel of the firearm.

According to an advantageous feature of the invention the magazine catch button extended left comprises a gripping surface, which gripping surface is advantageously formed as an in height altering surface level, and the magazine catch button extended right comprises a gripping surface.

According to an advantageous feature of the invention the magazine catch shaft comprises a right end and a left end, the right end of the shaft is attached to a threading of the magazine catch button right and the left end of the shaft is attached via a threading of the magazine catch lever to the magazine catch button extended left.

According to an advantageous feature of the invention the magazine catch body has a release position for releasing the magazine from the firearm and a standard position for locking the magazine to the firearm, in the release position the magazine catch button extended left and the magazine catch button extended right are pressed down and in the standard, locking position the magazine catch button extended left and the magazine catch button extended right are up.

According to an advantageous feature of the invention in the magazine catch body the magazine catch lever is configured to move, when position of the magazine catch buttons changes such, that during release pressing of the magazine catch buttons the magazine catch lever moves outwards releasing the magazine from the firearm and such, that for locking the magazine to the firearm the magazine is pressed to its location in the firearm, which is actuated by the spring configured to change the positions of the magazine catch buttons to standard locking position due to a sliding movement of the magazine catch lever during pressing the magazine to its location in the firearm.

According to an advantageous feature of the invention the magazine catch button extended left and the magazine catch button extended right connected to each other by a magazine catch shaft are configured to operate as one structural unity such, that the spring located around the magazine catch shaft is configured to press the magazine catch button extended right outwards from the outer surface of the firearm and simultaneously configured to draw the magazine catch lever at the left side turning the magazine catch button around its pivot point extended left upwards.

In this description the terms, back, front, upper, lower etc. are used as reference to the normal position of a firearm, when used for firing. They are not to have any as such limiting effect. Especially, it should be noted that the terms right and left are used as reference to the normal position of a firearm, when used for firing, and they are not to have any as such limiting effect. The magazine catch body according to the invention in view of the terms right and left can also be configured reversed.

By the magazine catch body according to the invention and its advantageous features: The magazine catch body provides for good ergonomics for the user of the firearm during locking and releasing the magazine to/from the firearm. The construction of the magazine catch body is without rattling and clanging. The magazine catch body provides for robust locking of the magazine to the firearm. Further, an improved ambidextrous magazine catch body is achieved, which is easy to use, well-reachable by the user during firing and provides for fast and secure magazine changes.

BRIEF DESCRIPTION OF THE DRAWINGS

In the following the invention and its advantages are explained in greater detail below in the sense of example and with reference to accompanying drawing, where In FIG. 1 is schematically shown an advantageous example of a firearm.

Figure 6:
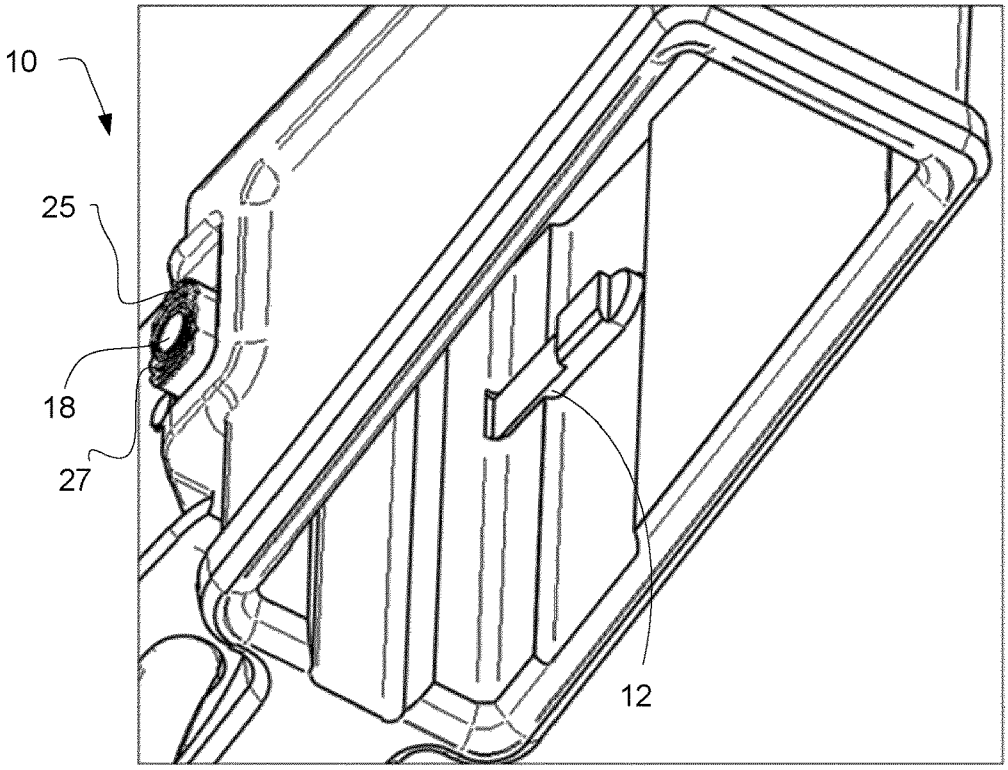
In FIG. 6 is schematically shown the advantageous example of the magazine catch body according to the invention shown in FIGS. 1-5 with the right magazine catch button in upper, standard position.
Figure 7:
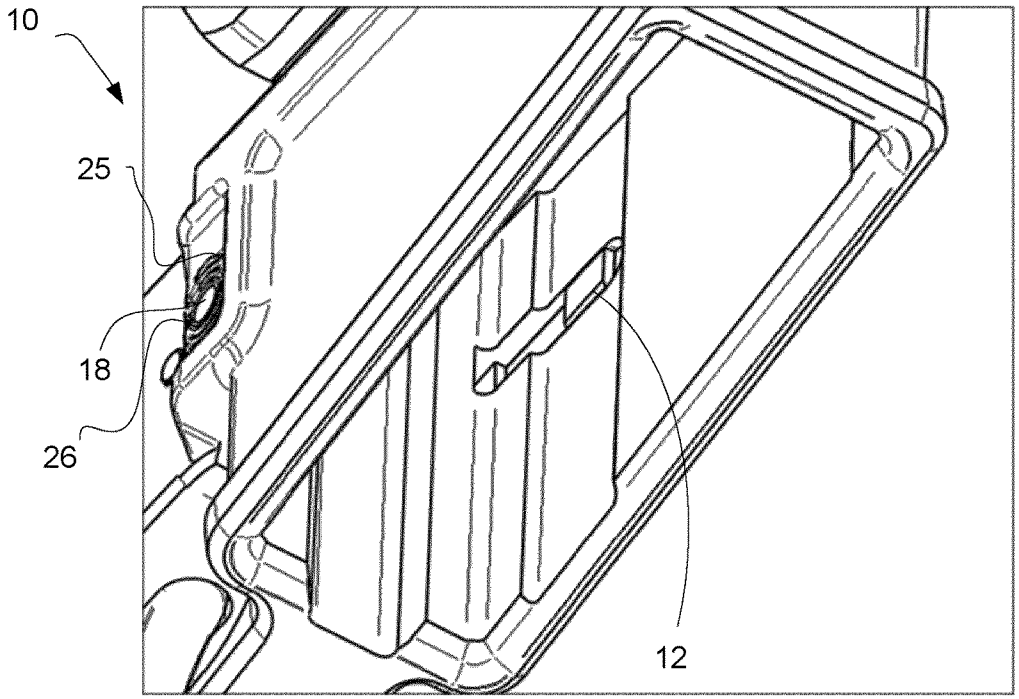
In FIG. 7 is schematically shown the advantageous example of the magazine catch body according to the invention shown in FIGS. 1-4 with the right magazine catch button pressed down, when the magazine is released.
Figure 8:
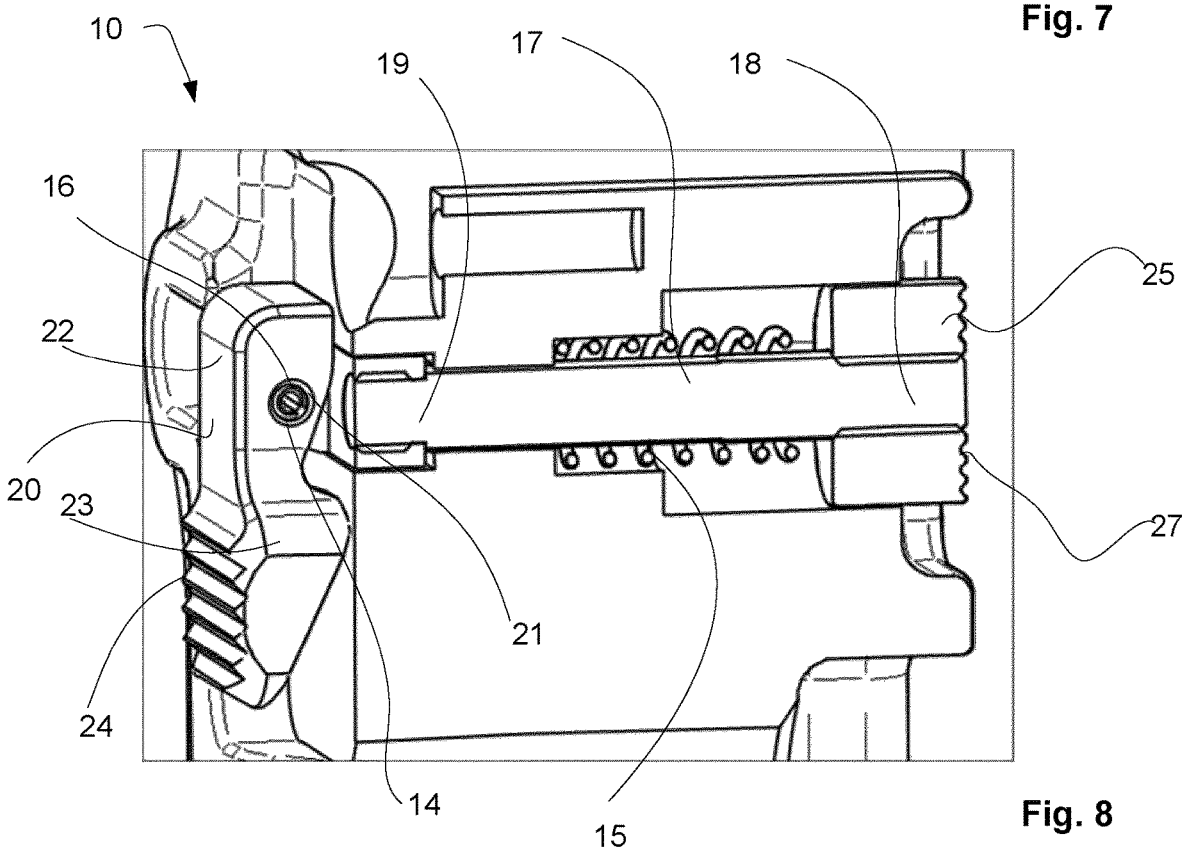

In the FIG. 8 is schematically, as a cut-away drawing, shown the advantageous example of the magazine catch body according to the invention shown in FIGS. 1-7.

Figure 9:
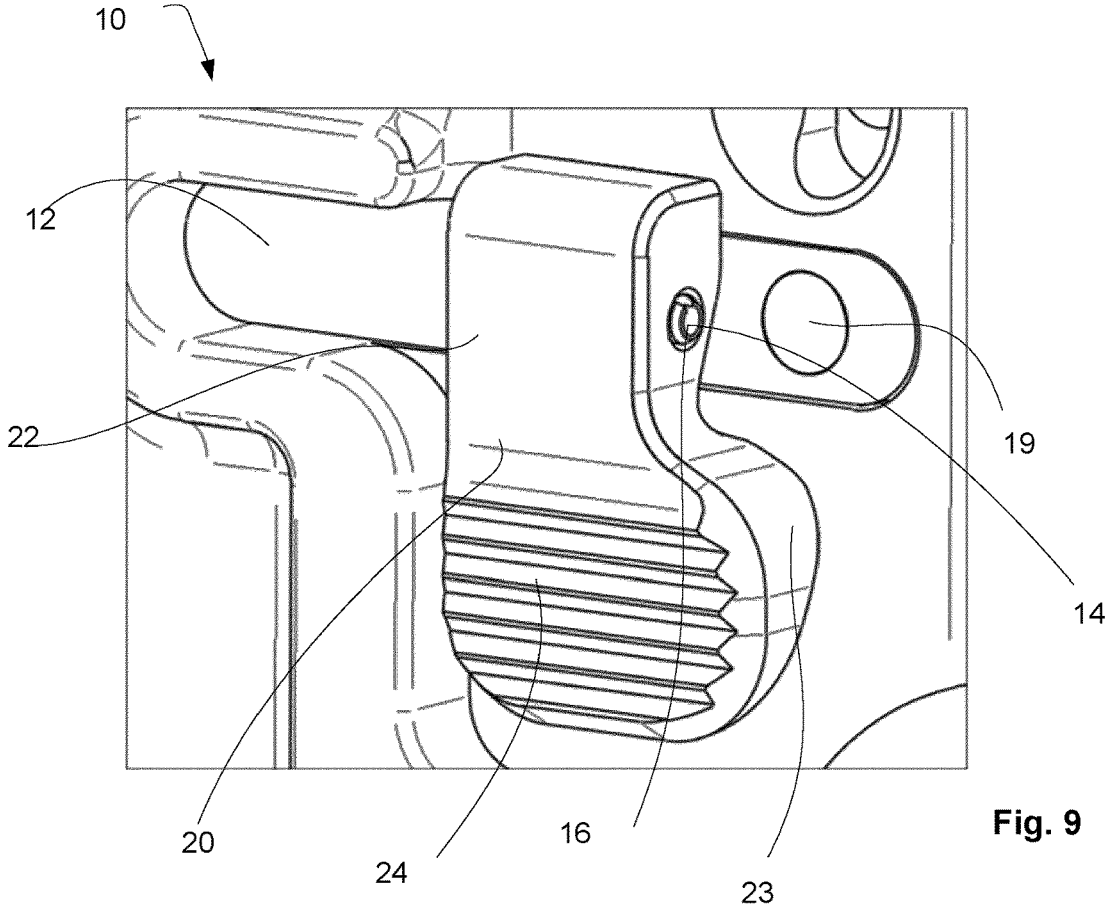
Figure 10:
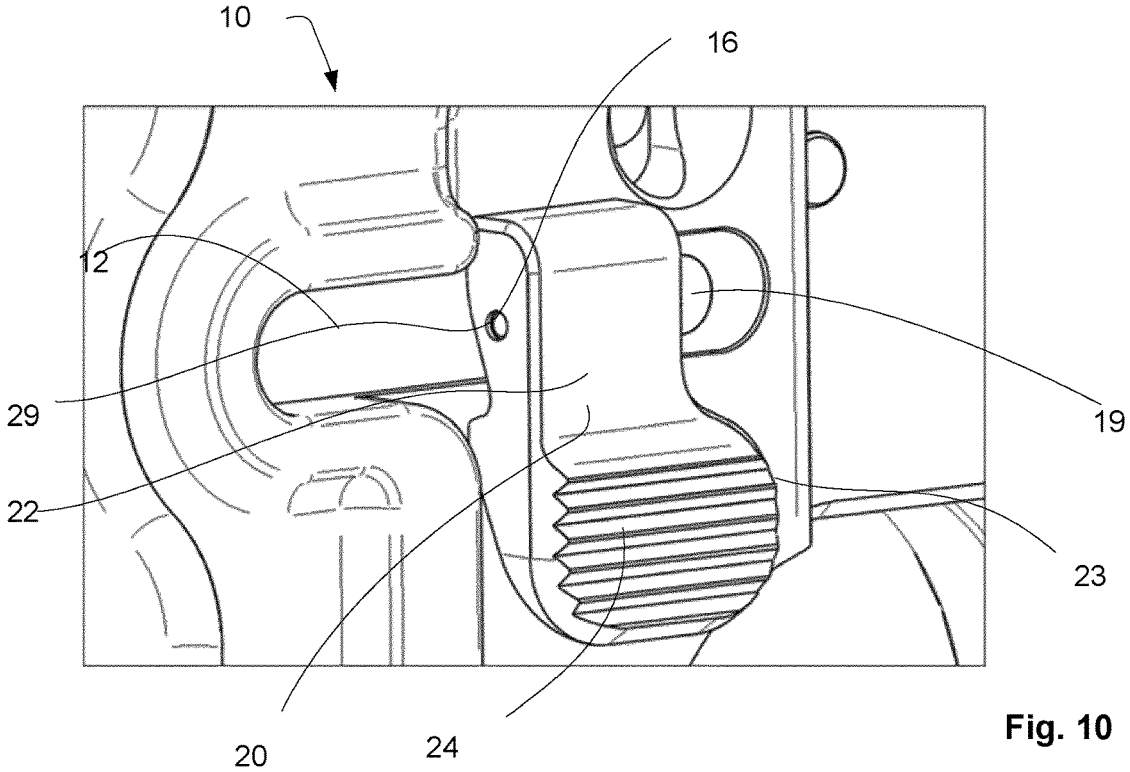

In FIGS. 9-10 is schematically, in more detail, shown the pin and its opening in the advantageous example of the magazine catch body according to the invention shown in FIGS. 1-8.

Figure 11A:
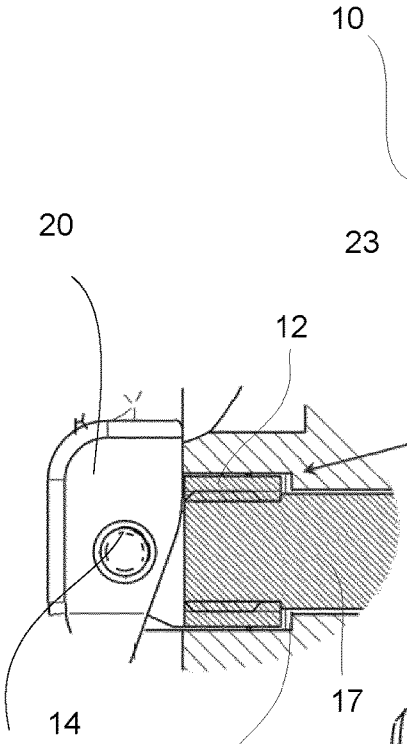
Figure 11B:
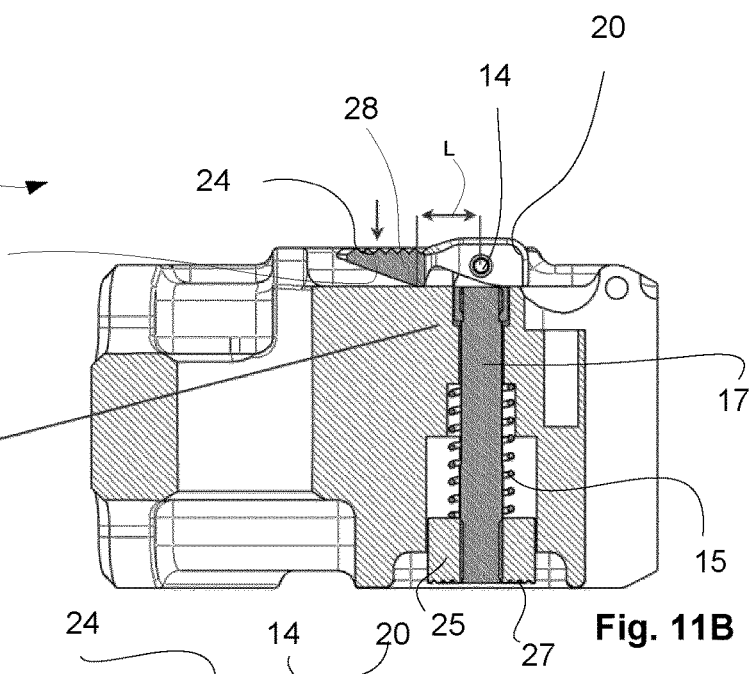
Figure 11C:
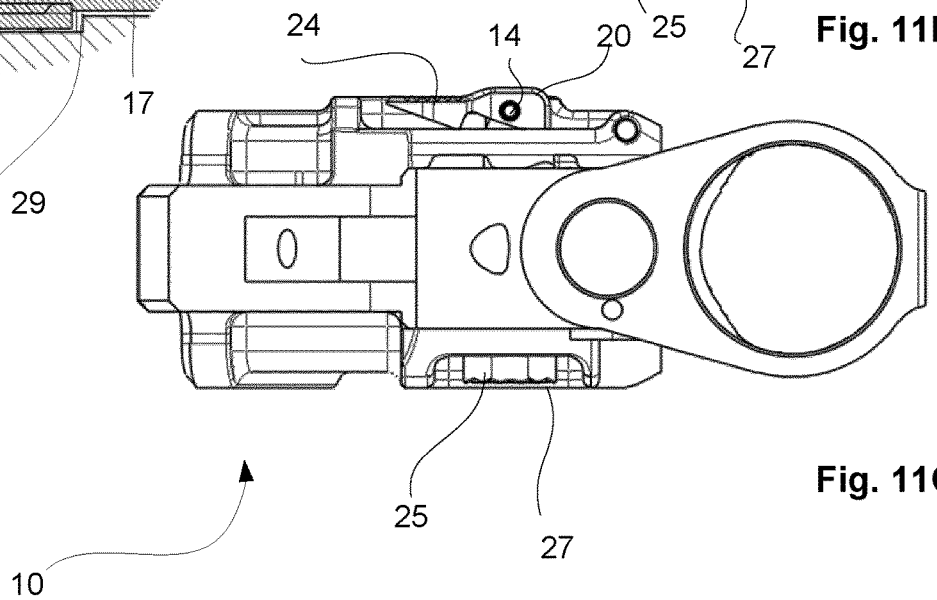

In FIGS. 11A-11C is schematically shown another advantageous example of the magazine catch body according to the invention.

DETAILED DESCRIPTION

During the course of the following description like numbers and signs will be used to identify like elements according to the different views which illustrate the invention and its advantageous examples. In the figures some repetitive reference signs may have been omitted for clarity reasons.

Figure 1:
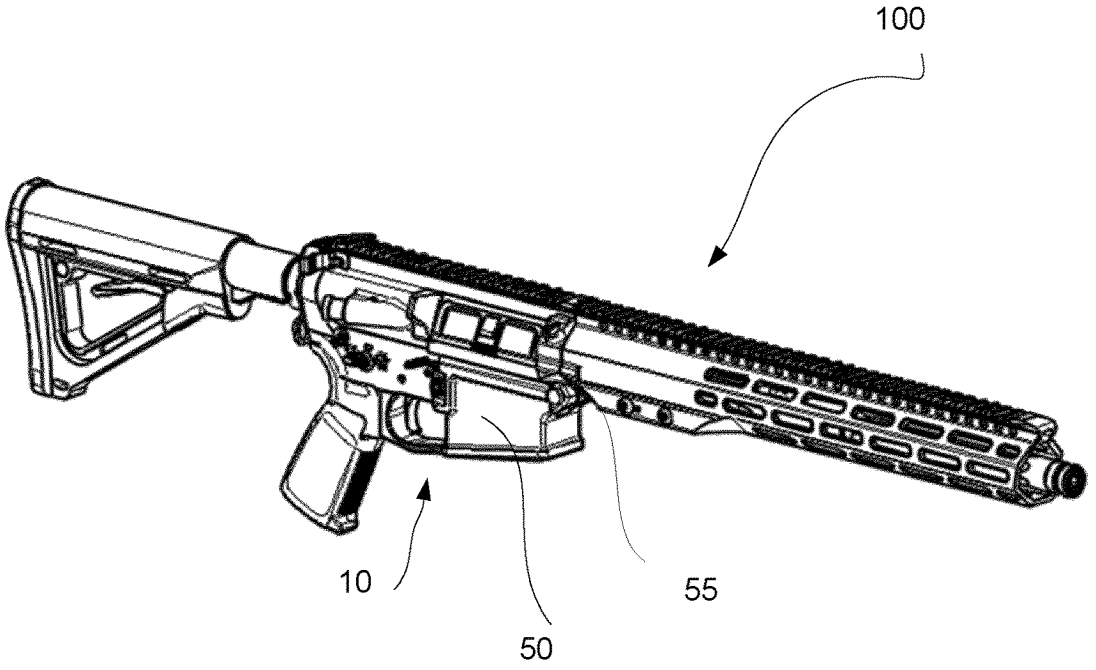
Figure 2:
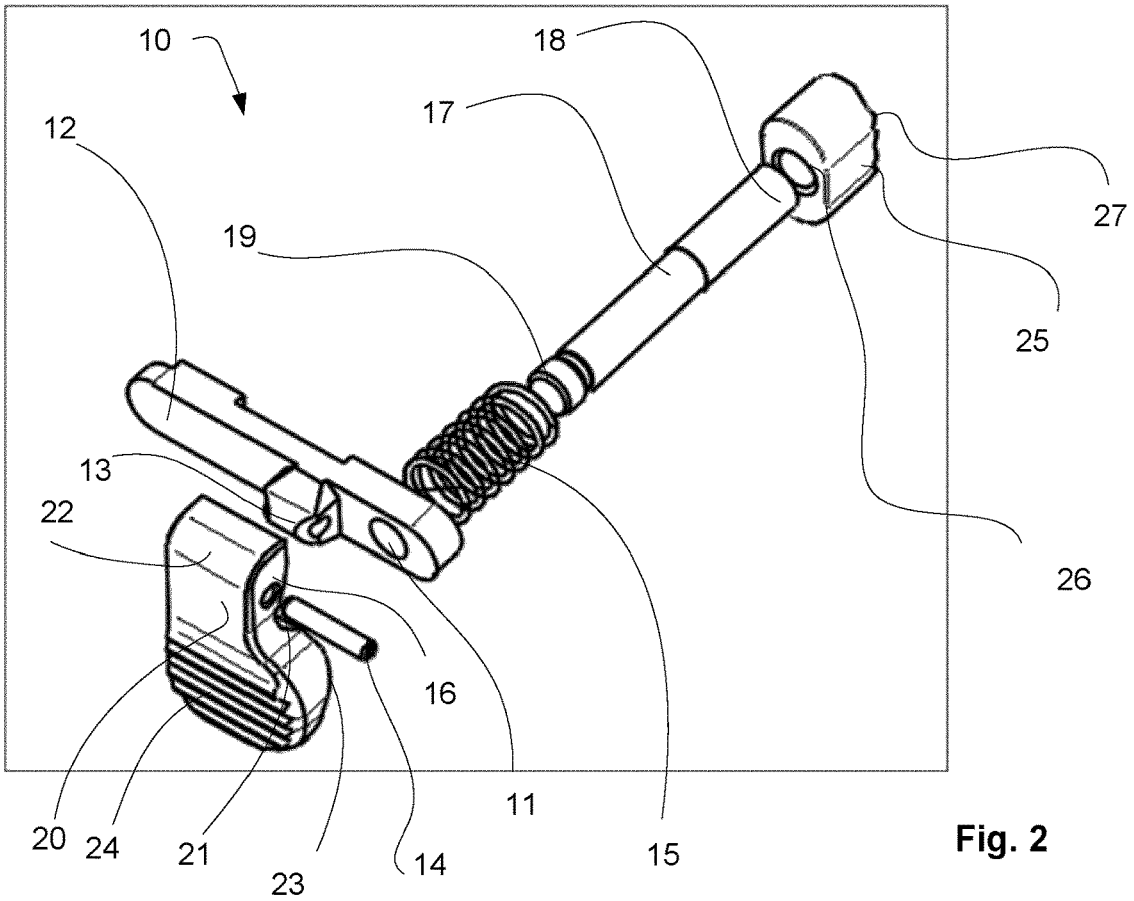
In FIG. 2 is schematically shown an advantageous example of a magazine catch body according to the invention as an exploded view.

In the FIG. 1 is shown an example of a firearm 100 comprising a magazine 50 located in lower receiver 55 of the firearm with a magazine catch body 10 to lock and/or release the magazine 50 to the firearm 100/from the firearm 100.

Figure 3:
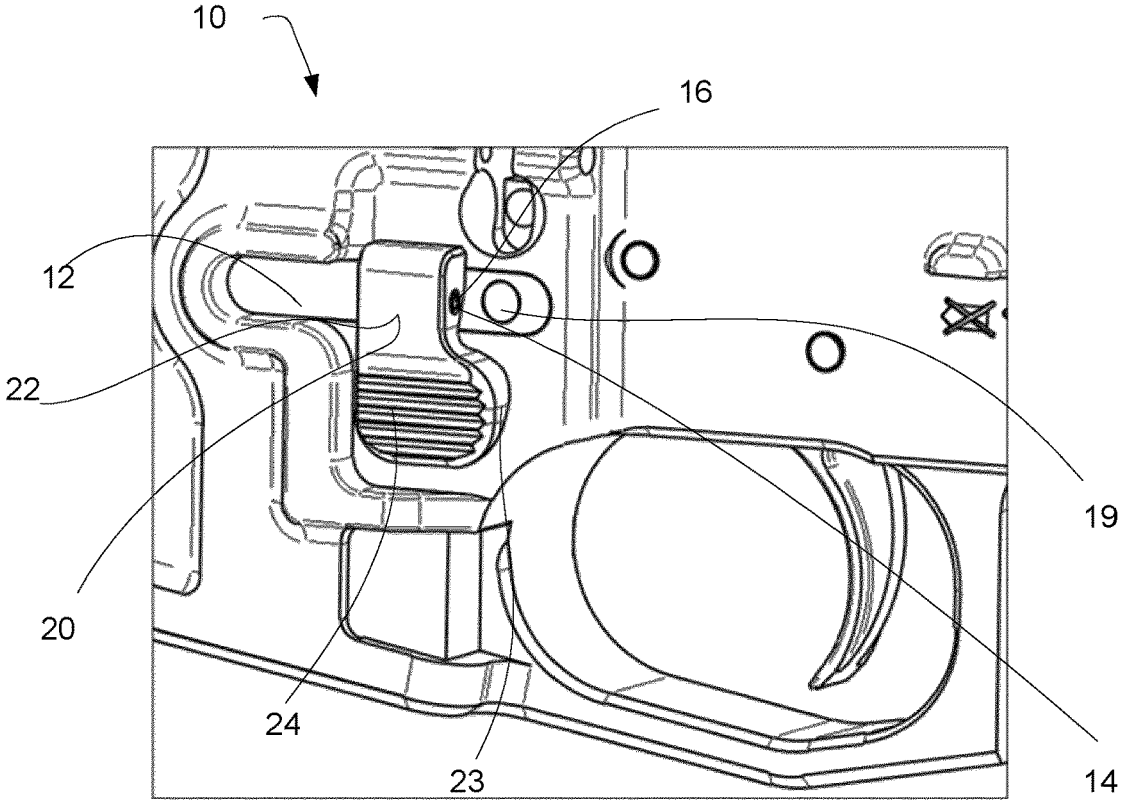
In FIG. 3 is schematically shown left side of the example of FIG. 2.
Figure 4:
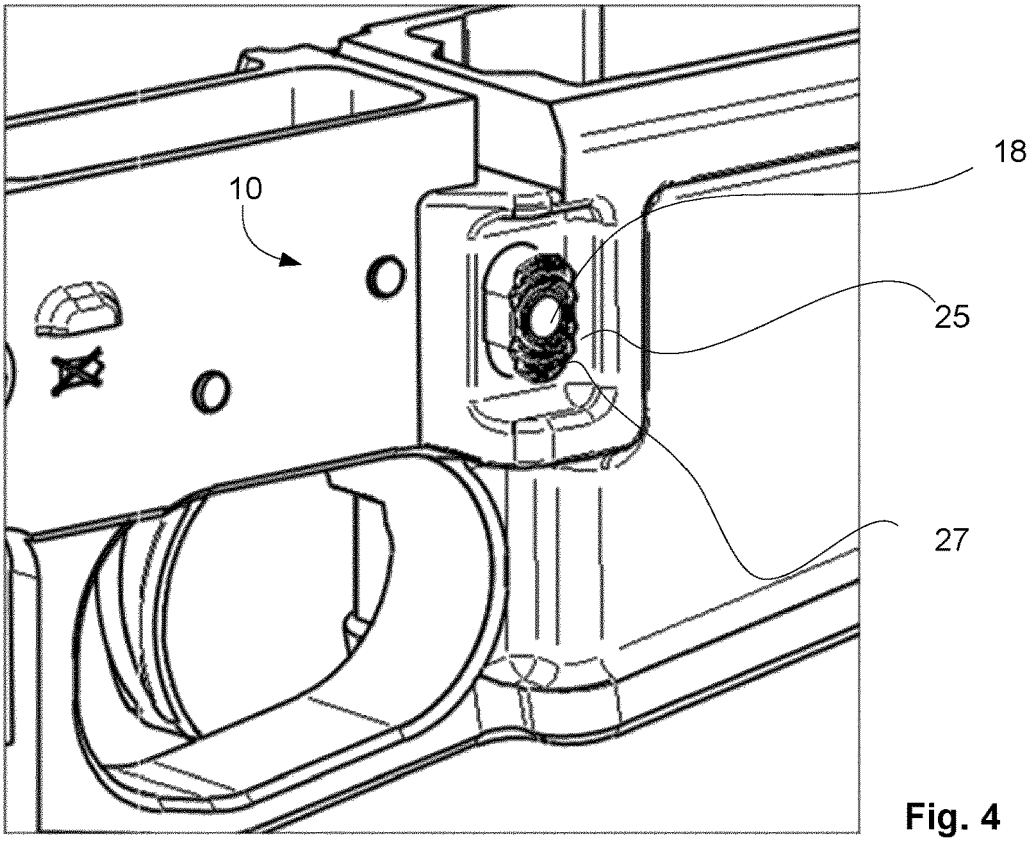
In FIG. 4 is schematically shown right side of the example of FIG. 2.

As shown in the example of FIG. 1-10 the magazine catch body 10 comprises a magazine catch button extended left 20 and a magazine catch button extended right 25 connected to each other by a magazine catch shaft 17, in which a right end 18 of the shaft 17 is attached to a threading 26 of the magazine catch button right 25 and in which a left end 19 of the shaft 17 is attached via a threading 11 of a magazine catch lever 12 to the magazine catch button extended left 20 to a threading 26 of the magazine catch button extended right 20 by the corresponding threading 11 in the left end 19 of the shaft 17. This attachment can also be provided by another attachment means known as such by one skilled in the art. The magazine catch lever 12 comprises a formfitting protrusion 13 for mounting against the magazine catch button extended left 20. Around the left end 19 of the shaft 17 a spring 15 is located. The magazine catch button extended right 25 comprises a gripping surface 27 on the outer side of the button 25. The magazine catch button extended left 20 comprises a gripping surface 24 on the outer side of the button 20. The magazine catch button extended left 20 is formed of a necked part 22 and a widened part 23. In the necked part 22 an opening 21 is located for a pin 14. The magazine catch button extended right 25 and the magazine catch button extended left 20 are substantially on the same height level in respect of the upper and lower surface of the firearm 100. The widened part 23 of the magazine catch button extended left 20 is asymmetrically widened towards the back of the firearm 100, thus substantially same symmetrical location for the magazine catch button extended right 25 and the magazine catch button extended left 20 is provided and functionality for the user of the firearm 100 is improved. As can be seen especially from FIGS. 3 and 4: the FIG. 3 schematically showing the left side of the example of FIG. 2, i.e. left side of the firearm 100 and the FIG. 4 schematically showing the right side of the example of FIG. 2, i.e. right side of the firearm 100 the magazine catch body 10 can be used both from the right side and the left side of the firearm 100. The magazine catch button extended left 20 and the magazine catch button extended right 25 are configured to form the magazine catch body 10 functionable as one mechanism. The gripping surface 24 of the magazine catch button extended left 20 is advantageously formed as an in height altering surface levels, i.e. the gripping surface 24 comprises protrusions and/or grooves.

Figure 5:
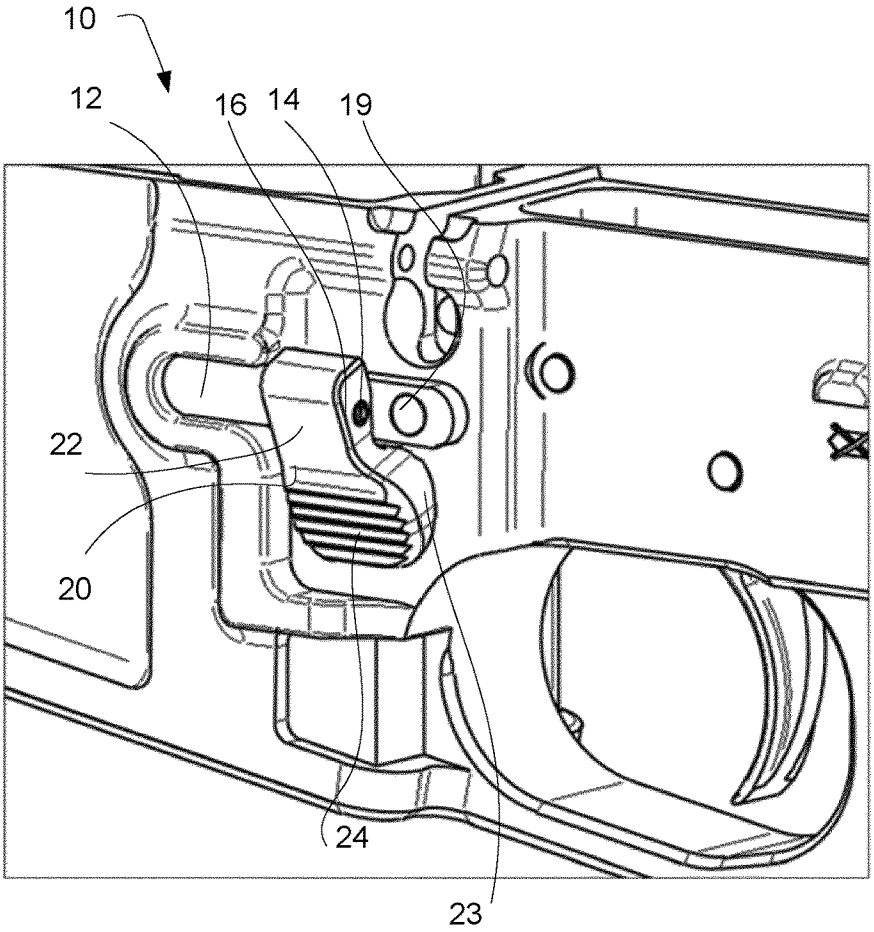
In FIG. 5 is schematically shown the advantageous example of the magazine catch body according to the invention shown in FIG. 1-4 with the left magazine catch button pressed down, when the magazine is released.

In FIG. 5 the magazine catch body 10 is in a release position for releasing the magazine 50 from the firearm 100. The magazine catch button extended left 20 is pressed down such that the widened part 23 is turned towards the outer surface of the firearm 100. The magazine catch button extended left 20 also comprises a groove like joining area of the necked part 22 and the widened part 23 towards the outer surface of the firearm 100, thus providing fitting against the magazine catch lever 12, when the magazine catch button extended left 20 is turned around a pivot point 16 formed of the pin 14 located in the opening 21 of the necked part 22 of the magazine catch button extended left 20. The widened part 23 of the magazine catch button extended left 20 also has an elevated in the area of the gripping surface of the firearm 100, thus preventing over-turning of the magazine catch button extended left 20 during movements from/to the standard, locking position to/from the release position.

In FIG. 6 the magazine catch body 10 is in a standard position for locking the magazine 50 to the firearm 100. The magazine catch button extended right 25 is in upper position and the magazine 50 stays in its location in the firearm 100.

In FIG. 7 is the magazine catch body 10 is in a release position for releasing the magazine 50 from the firearm 100. The magazine catch button extended right 25 is pressed down towards the outer surface of the firearm 100, when the magazine is released.

As can be seen from the FIGS. 5-7 the magazine catch lever 12 moves as the magazine catch buttons' 20, 25 position changes. During release pressing of the magazine catch buttons 20, 25 the magazine catch lever 12 moves outwards releasing the magazine 50 from the firearm 100. For locking the magazine 50 to the firearm 100 the magazine is pressed to its location in the firearm 100, which actuated by the spring 15 is configured to change the positions of the magazine catch buttons 20, 25 to locking position due to the sliding movement of the magazine catch lever 12 during pressing the magazine 50 to its location in the firearm 100.

As can be seen from the FIG. 8 during locking movement of the magazine 50 to the firearm 100 the magazine catch button extended left 20 and the magazine catch button extended right 25 connected to each other by a magazine catch shaft 17 are configured to operate as one structural unity. The spring 15 located around the magazine catch shaft 17 is configured to press the magazine catch button extended right 25 outwards from the outer surface of the firearm 100 and simultaneously configured to draw the magazine catch lever 12 at the left side turning the magazine catch button 20 and its widened part 23 upwards. As can be seen from the figure the necked part 22 of the magazine catch button extended left 20 is configured to press against the lower receiver 55 of the firearm 100 and to receive the draw of the spring 15 causing a holding force, which provides that the magazine catch body 10 does not rattle and clang during use as there are no substantial free plays in the mounting of the magazine catch button extended left 20.

As shown in the FIGS. 9-10 the pin 14 mounted in the opening 21 in the necked part 23 of the magazine catch button extended left 20 forms an attachment for the magazine catch button extended left 20 and an axis for the turning movement of the magazine catch button extended left 20 between the locking, standard position and the releasing position for the magazine 50 of the firearm 100. As can be seen from the FIG. 10 the opening 21 for the pin 14 decreases towards the front of the firearm 100, which prevents the pin 14 to move from its position due to recoil-forces caused by firing the firearm 100.

For maintenance and like purposes the pin 14 can be removed by using a mandrel or like tool by pushing the pin 14 at its end through the opening 21.

As shown in the example of FIGS. 11A-11C the magazine catch body 10 comprises a magazine catch button extended left 20 and a magazine catch button extended right 25 connected to each other by a magazine catch shaft 17. The main structure and features of the magazine catch body 10 of this example corresponds to those of the example of FIGS. 1-10. In this example the gripping surface 24 of the magazine catch button extended right 25 has a lowered push button profile, whereby the outer surface of the magazine catch button extended right 25 does not exceed and advantageously is in line with the outer surface of the firearm, as can be seen from the figures, for increased prevention of accidental release of the magazine for example due to the magazine catch button extended right 25 contacting an obstacle by oversight. In this example also distance L between the imaginary center axis of the pin 14, i.e. the pivot point of the magazine catch button extended left 20, and the contact point 28 of the widened part 23 of the magazine catch button extended left 20 has been increased for higher push force of the magazine catch button extended left 20. Additionally, an air gap 29 is located between the magazine catch lever 12 and the lower receiver 55 of the firearm 100. Because of this magazine catch button extended left 20 rests on the outer surface of lower receiver of the firearm, thus the rattle-free magazine release is further improved.

In the description in the foregoing, although some functions and elements have been described with reference to certain features and examples, those functions and elements may be performable by other features and examples whether described or not. Although features have been described with reference to certain embodiments or examples, those features may also be present in other embodiments or examples whether described or not.

Above only some advantageous examples of the inventions have been described to which examples the invention is not to be narrowly limited and many modifications and alterations are possible within the invention.

REFERENCE SIGNS USED IN THE DRAWING

10 magazine catch body
11 threading for the magazine catch shaft
12 magazine catch lever
13 protrusion
14 pin
15 spring
16 pivot point
17 magazine catch shaft
18 right end of the shaft
19 left end of the shaft
20 magazine catch button extended left
21 opening for the pin
22 necked part
23 widened part
24 gripping surface
25 magazine catch button extended right
26 threading for the shaft
27 gripping surface
29 air gap
50 magazine
55 lower receiver
100 firearm

The invention claimed is:

1. A magazine catch body of a firearm, which firearm comprises a magazine and a magazine catch body, which magazine catch body comprises a magazine catch button extended left, a magazine catch button extended right and a magazine catch shaft configured to connect the magazine catch button extended left and the magazine catch button extended right to each other, which magazine catch body further comprises a magazine catch lever connected to the magazine catch shaft and is configured to transmit locking and releasing movements of the magazine catch button extended left and the magazine catch button extended right to the magazine of the firearm to lock and to release the magazine to the firearm, correspondingly, which magazine catch body further comprises a spring located around the shaft, which magazine catch button extended right and the magazine catch button extended left are substantially symmetrically located in respect to the firearm, which magazine catch button extended left and the magazine catch button extended right are configured to form the magazine catch body to one structural unity and functionable as one mechanism, which magazine catch button extended left of the magazine catch body comprises a necked part and a widened part, wherein in the necked part an opening is located for a pin configured to form a turning axis of the magazine catch button extended left, wherein the opening for the pin decreases towards the front of the firearm, which prevents the pin to move from its position due to forces caused by firing the firearm and wherein the necked part of the magazine catch button extended left is configured to continuously press against the lower receiver of the firearm and to receive draw of the spring causing a holding force, wherein the holding force prevents free movement of the magazine catch button extended left about the pivot point.

2. The magazine catch body according to claim 1, wherein an air gap is located between the magazine catch lever and the lower receiver of the firearm.

3. The magazine catch body according to claim 1, wherein the widened part of the magazine catch button extended left is asymmetrically widened towards the back part of the firearm.

4. The magazine catch body according to claim 1, wherein the widened part of the magazine catch button extended left is elevated in the area of the surface of the firearm.

5. The magazine catch body according to claim 1, wherein the magazine catch button extended left comprises a groove like joining area of the necked part and the widened part towards the outer surface of the firearm.

6. The magazine catch body according to claim 1, wherein the pin mounted in the opening of the necked part of the magazine catch button extended left is configured to form an attachment for the magazine catch button extended left and an axis for the turning movement of the magazine catch button extended left around a pivot point between the locking, standard position and the releasing position for the magazine of the firearm.

7. The magazine catch body according to claim 1, wherein the magazine catch button extended left comprises a gripping surface, which gripping surface is advantageously formed as an in height altering surface level and the magazine catch button extended right comprises a gripping surface.

8. The magazine catch body according to claim 1, wherein the magazine catch shaft comprises a right end and a left end, wherein the right end of the shaft is attached to a threading of the magazine catch button right, and wherein the left end of the shaft is attached via a threading of the magazine catch lever to the magazine catch button extended left.

9. The magazine catch body according to claim 1, wherein the magazine catch body has a release position for releasing the magazine from the firearm and a standard position for locking the magazine to the firearm, wherein in the release position the magazine catch button extended left and the magazine catch button extended right are pressed down, and wherein in a standard, locking position the magazine catch button extended left and the magazine catch button extended right are up.

10. The magazine catch body according to claim 1, wherein in the magazine catch body the magazine catch lever is configured to move, when position of the magazine catch buttons changes such, that during release pressing of the magazine catch buttons the magazine catch lever moves outwards releasing the magazine from the firearm and such, that for locking the magazine to the firearm the magazine is pressed to its location in the firearm, which is by the spring actuated configured to change the positions of the magazine catch buttons to standard locking position due to a sliding movement of the magazine catch lever during pressing the magazine to its location in the firearm.

11. The magazine catch body according to claim 1, wherein the magazine catch button extended left and the magazine catch button extended right connected to each other by a magazine catch shaft are configured to operate as one structural unity such, that the spring located around the magazine catch shaft is configured to press the magazine catch button extended right outwards from the outer surface of the firearm and simultaneously configured to draw the magazine catch lever at the left side turning the magazine catch button extended left upwards around a pivot point.

12. A magazine catch body of a firearm, which firearm comprises a magazine and a magazine catch body, which magazine catch body comprises a magazine catch button extended left, a magazine catch button extended right and a magazine catch shaft configured to connect the magazine catch button extended left and the magazine catch button extended right to each other, which magazine catch body further comprises a magazine catch lever connected to the magazine catch shaft and is configured to transmit locking and releasing movements of the magazine catch button extended left and the magazine catch button extended right to the magazine of the firearm to lock and to release the magazine to the firearm, correspondingly, which magazine catch body further comprises a spring located around the shaft, which magazine catch button extended right and the magazine catch button extended left are substantially symmetrically located in respect to the firearm, which magazine catch button extended left and the magazine catch button extended right are configured to form the magazine catch body to one structural unity and functionable as one mechanism, which magazine catch button extended left of the magazine catch body comprises a necked part and a widened part, wherein in the necked part an opening is located for a pin configured to form a turning axis of the magazine catch button extended left, wherein the opening for the pin decreases towards the front of the firearm, which prevents the pin to move from its position due to forces caused by firing the firearm and wherein the necked part of the magazine catch button extended left is configured to continuously press against the lower receiver of the firearm and to receive draw of the spring causing a holding force, wherein the necked part of the magazine catch button extended left extends above the turning axis.

* * * * *